United States Patent [19]

Pedersen

[11] 3,934,694

[45] Jan. 27, 1976

[54] COIN-CONTROLLED FLUID DISPENSER

[76] Inventor: Harry Pedersen, Terneveien 50, 4042 Hafrsfjord, Norway

[22] Filed: Feb. 24, 1974

[21] Appl. No.: 552,123

[52] U.S. Cl. ..... 194/82
[51] Int. Cl.[2] ..... G07F 13/02
[58] Field of Search ..... 194/78, 79, 80, 81, 82

[56] References Cited

UNITED STATES PATENTS

| | | | |
|---|---|---|---|
| 1,031,140 | 7/1912 | McLaren | 194/79 |
| 1,794,641 | 3/1931 | Payson et al. | 194/82 |

*Primary Examiner*—Stanley H. Tollberg
*Attorney, Agent, or Firm*—Young & Thompson

[57] ABSTRACT

A coin-operated apparatus for dispensing a predetermined volume of a fluid to be purchased by insertion of a coin into a slot, includes a plunger for forcing the coin between two slides, one of which is moved by the coin to a fluid pumping position and the other of which is moved by a piston after the predetermined volume of fluid has been pumped, to a coin release position. Upon coin release, the fluid pumping is discontinued and the piston moves back to dispense the purchased fluid, whereupon the parts return to their initial position. The two slides move at right angles to each other.

8 Claims, 2 Drawing Figures

COIN-CONTROLLED FLUID DISPENSER

The present invention relates to coin-controlled apparatus for dispensing a predetermined volume of fluid. Preferably, the fluid is a liquid, such as water or a solvent, for washing, degreasing or desalting operations.

It is an object of the present invention to provide a coin-controlled apparatus for fluid dispensing, which will be relatively simple and inexpensive to construct, easy to operate, maintain and repair, and rugged and durable in use.

Figure 1:
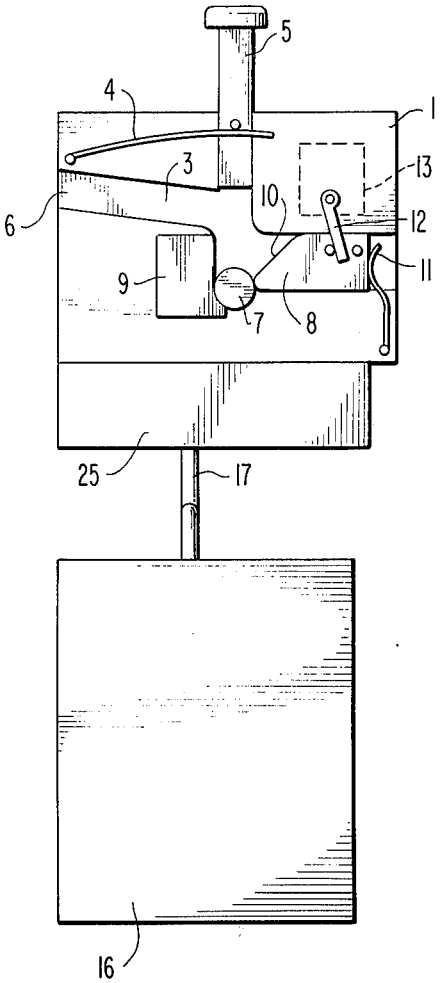
Figure 2:
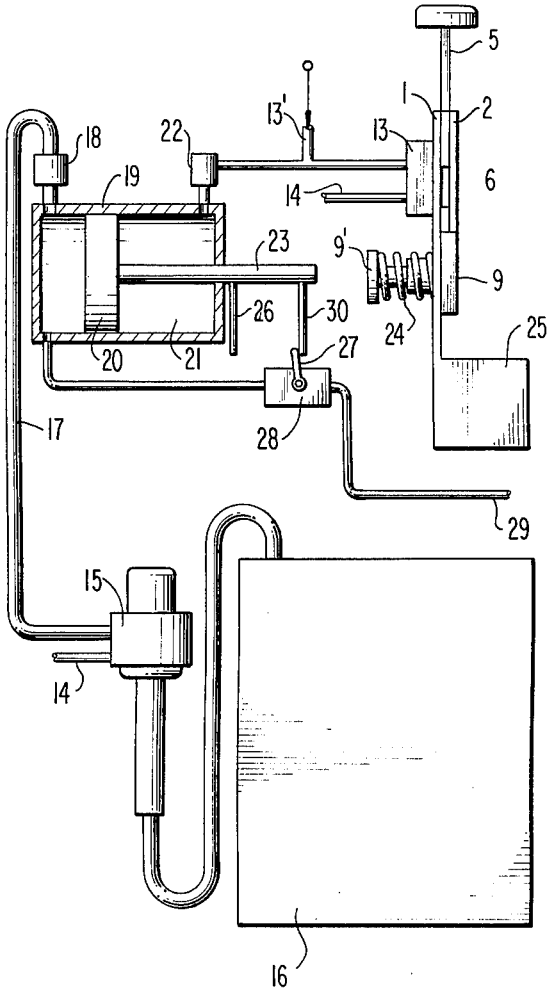

Other objects, features and advantages of the present invention will become apparent from a consideration of the following description, taken in connection with the accompanying drawings, in which:

FIG. 1 is a somewhat diagrammatic front view of a coin-controlled apparatus according to the present invention, with a cover plate thereof removed; and FIG. 2 is a somewhat diagrammatic side elevational view of the apparatus shown in FIG. 1, but with the cover plate in place.

Referring now to the drawing in greater detail, there is shown apparatus according to the present invention, comprising a fixed mounting plate 1 to which is removably secured a cover plate 2, the cover plate 2 being shown in place in FIG. 2, but removed in FIG. 1 for clarity of illustration. An inclined coin chute or guideway 3 in mounting plate 1 is of a size to receive coins of the desired denomination and is closed by cover plate 2, the plates 1 and 2 defining a coin chute 3 between them. A spring 4 secured between plates 1 and 2 continuously urges upwardly an actuating plunger 5 so that when coins 7 are inserted through slot 6 and reach the lower end of chute 3, the plunger 5 can be depressed to push them into the FIG. 1 position. When the plunger 5 is depressed and pushes down the coin 7, the coin 7 does not fall but rather is held between a horizontally reciprocable slide 8 and a slide 9 which remains stationary at that time. The downward movement of the coin 7 under the pressure of plunger 5 causes the coin to act on inclined cam surface 10 of slide 8, which forces slide 8 to the right or FIG. 1 position against the action of spring 11 fixed to mounting plate 1.

Rightward movement of slide 8 to the FIG. 1 position swings the finger 12 counterclockwise as seen in FIG. 1, which opens compressed air valve 13 for the flow of compressed air from a source 13' thereof, the compressed air then flowing through conduit 14 to operate pump 15 which pumps the fluid to be dispensed, in this case a liquid, from a reservoir 16 thereof through the conduit 17 and through a check valve 18 to a cylinder 19. A piston 20 in cylinder 19 is moved by the pumped fluid, in this case a liquid, to the right so as to reduce the volume of chamber 21 within cylinder 19. Compressed air under pressure which has been reduced through a pressure reduction valve 22 is applied to chamber 21 to oppose but not to prevent the rightward movement of piston 20 under the impetus of the pumped fluid.

Piston 20 carries an axially extending piston rod 23 that extends toward slide 9. A coil-compression spring 24 continuously urges slide 9 toward its coin-retaining position shown in the drawing. But when piston rod 23 moves sufficiently far to the right as seen in FIG. 2, it contacts an abutment 9' on slide 9, to move slide 9 to the right as seen in FIG. 2, out of coin-retaining position. At this time, the predetermined quantity of fluid now occupies cylinder 19 to the left of piston 20.

With slide 9 no longer retaining it, the coin 7 then drops into coin box 25, whereupon slide 8 moves to the left as seen in FIG. 1, under the impetus of spring 11, swinging finger 12 clockwise to close compressed air valve 13, whereupon pump 15 stops and the flow of pumped fluid also stops. At the same time, a stud 26 carried by piston rod 23 swings finger 27 clockwise to open valve 28 so that the stored fluid to be dispensed can flow out through a conduit 29 to a gun or other dispensing head or nozzle (not shown) through which the predetermined quantity of the purchased fluid can be dispensed in the desired manner.

However, the supply of compressed air from source 13' through pressure reducing valve 22 continues, so that piston 20 is now forced to the left as seen in FIG. 2, whereby the purchased fluid is dispensed. When stud 30 on piston rod 23 contacts and swings finger 27 counterclockwise, as seen in FIG. 2, valve 28 is closed thereby terminating the flow of dispensed fluid through conduit 29 when that flow has equaled the purchased volume. Spring 24 returns slide 9 to its coin-retaining position, and the parts are again in their initial position, ready to receive another coin and dispense another predetermined quantity of fluid.

From consideration of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in the art will readily understand. Such modifications and variations are considered to be within the purview and scope of the present invention as defined by the present appended claims.

Having described my invention, I claim:

1. A coin-controlled apparatus for dispensing a predetermined quantity of a fluid, comprising a coin chute defined in part by a pair of slides, means for inserting a coin in said chute between said slides so as to move one of said slides in one direction, means responsive to movement of said one slide in said one direction to pump said predetermined quantity of fluid while said coin holds said one slide in its moved position, and means responsive to movement of said dispensing means to move the other said slide in another direction different from said one direction when said predetermined quantity of fluid has been pumped thereby to permit said coin to fall out of contact from said slides, and means to return said slides to their initial position.

2. Apparatus as claimed in claim 1, said directions being at right angles to each other.

3. Apparatus as claimed in claim 1, and a source of compressed air, a valve communicating with the source of compressed air, means responsive to movement of said one slide to open said valve when said coin is held between said slides and to close said valve when said coin is out of contact with said one slide, thereby to actuate and de-actuate respectively said pumping means.

4. Apparatus as claimed in claim 3, and piston means for dispensing said pumped fluid, and means to supply compressed air from said source to said piston means to actuate said piston means to dispense said pump fluid.

5. Apparatus as claimed in claim 4, and valve means responsive to the position of said piston to open and close a conduit for the dispensing of said pumped fluid.

6. Apparatus as claimed in claim 4, and means responsive to the position of said piston to move said other slide in said another direction and to return said other slide to an intial position in a direction opposite said another direction.

7. Apparatus as claimed in claim 1, and a cylinder in which the pumped fluid is stored, a piston reciprocable in said cylinder, means continuously urging said piston in a direction to dispense said fluid from said cylinder, and means responsive to the position of said piston to move said other slide in said another direction.

8. Apparatus as claimed in claim 7, and means responsive to the position of said piston to open and close a conduit through which said stored fluid is dispensed from said cylinder.

* * * * *